United States Patent [19]

Snellman et al.

[11] 4,173,113

[45] * Nov. 6, 1979

[54] THERMALLY STABLE HELICALLY PLIED CABLE

[75] Inventors: Donald L. Snellman; Willard G. Hudson, both of Seattle, Wash.

[73] Assignee: Norfin, Inc., Seattle, Wash.

[ * ] Notice: The portion of the term of this patent subsequent to Jul. 2, 1991, has been disclaimed.

[21] Appl. No.: 556,090

[22] Filed: Mar. 7, 1975

Related U.S. Application Data

[60] Continuation-in-part of Ser. No. 466,174, May 2, 1974, abandoned, which is a division of Ser. No. 311,361, Dec. 1, 1972, Pat. No. 3,821,879.

[51] Int. Cl.[2] ..... D02G 3/18; D02G 3/40; D07B 1/02; D07B 1/16

[52] U.S. Cl. ..... 57/249; 57/229; 57/234; 57/240; 57/251; 57/378

[58] Field of Search ..... 57/153, 140 C, 140 G, 57/149, 162, 164; 428/378, 377, 375

[56] References Cited

U.S. PATENT DOCUMENTS

| | | | |
|---|---|---|---|
| 3,309,861 | 3/1967 | Pierson et al. | 57/149 X |
| 3,371,476 | 3/1968 | Costello et al. | 57/149 |
| 3,662,533 | 5/1972 | Snellman et al. | 57/140 C X |
| 3,717,720 | 2/1973 | Snellman | 57/149 X |
| 3,821,879 | 7/1974 | Snellman et al. | 57/140 G |

*Primary Examiner*—John Petrakes
*Attorney, Agent, or Firm*—Dowrey & Cross

[57] ABSTRACT

The cable includes continuous glass filaments which are helically plied in rovings at a constant helical angle from cable center to outer surface and bonded together in elastomeric material. When heated, thermal elongation of the filaments is opposed by simultaneous radially directed thermal volumetric expansion of the elastomeric material. Thus, with respect to overall cable length, thermal elongation of the cable is opposed by a simultaneous increase in cable cross sectional area such that thermal elongation effects are controllable, dependent upon the thermal expansion properties of the filament and elastomeric materials used, by controlling the helical angle at which the filaments are plied to obtain either expanding, contracting or constant length cables, as desired. Thermal contraction effects produced by cooling the cable also are controllable by controlling the helical angle. In some high tensile load cable applications, the helical angle additionally may be related to tensile load, depending upon the modulus of elasticity of the filaments used. The invention is particularly adapted to helically plied glass fiber cables which are thermally stable over a wide range of temperatures.

40 Claims, 12 Drawing Figures

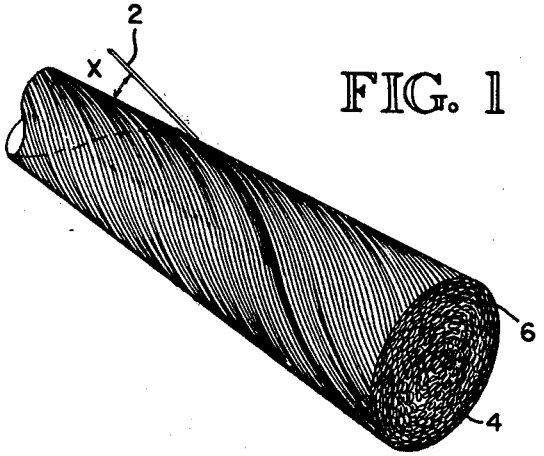
FIG. 1
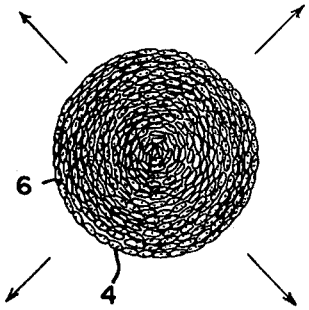
FIG. 2
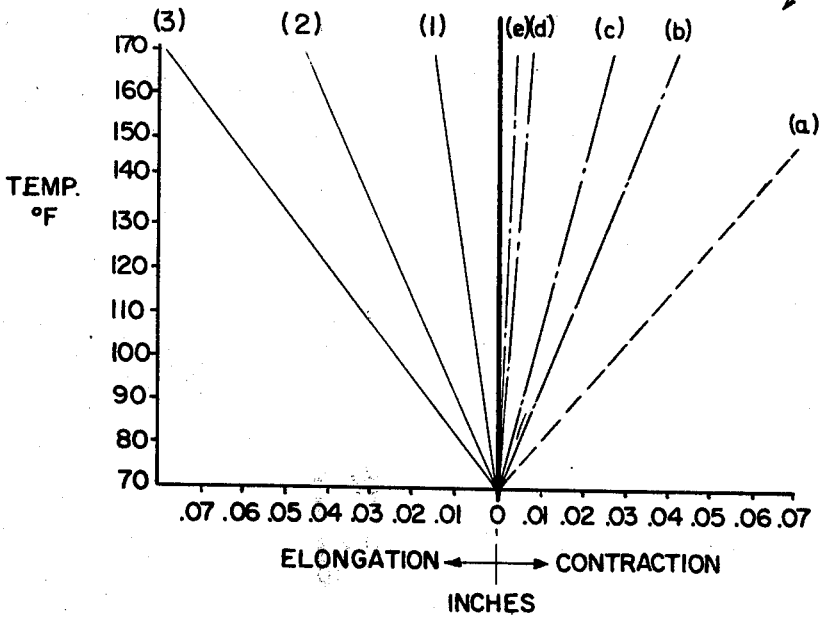
FIG. 3
FIG. 4
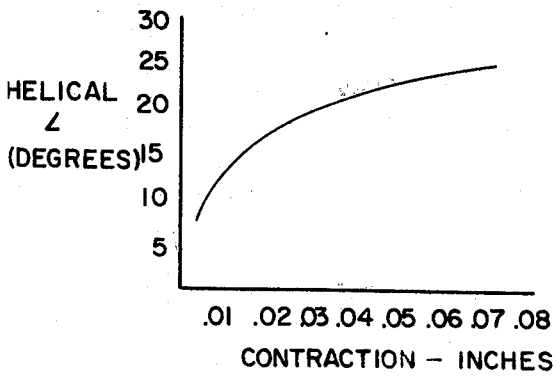
FIG. 5
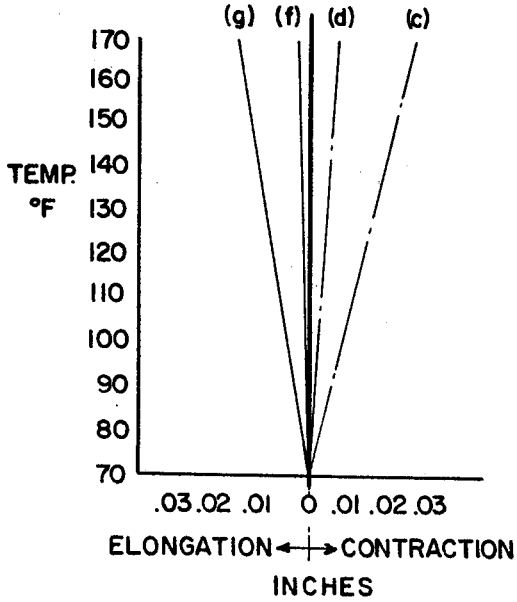

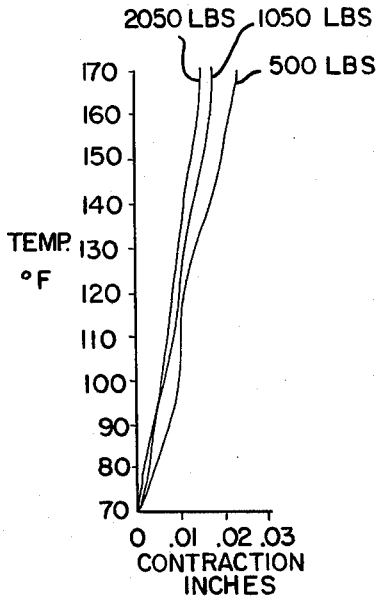
FIG. 11
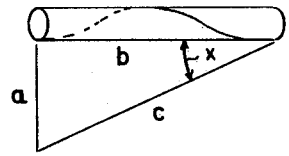
FIG. 6
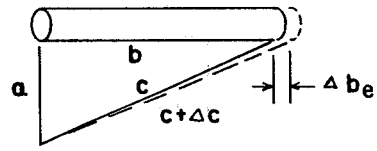
FIG. 7
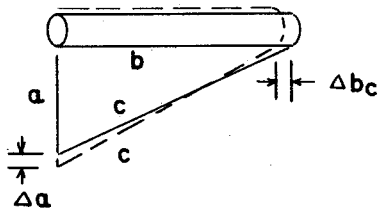
FIG. 8
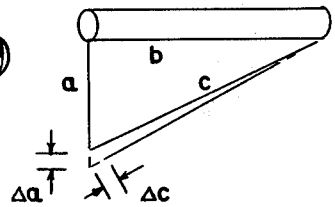
FIG. 9
FIG. 10
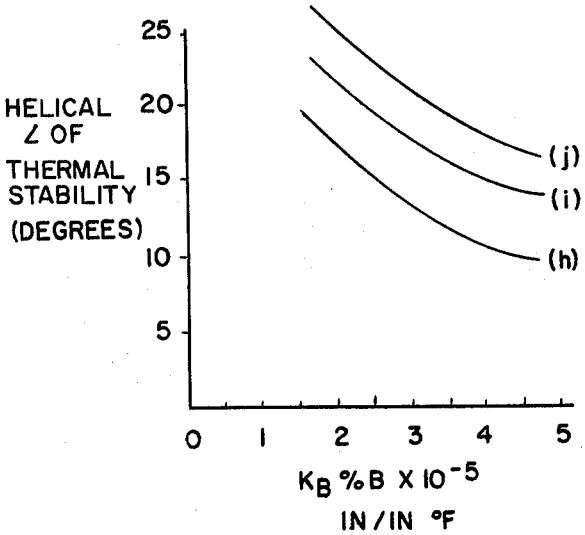
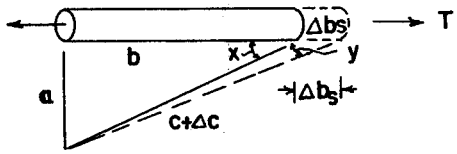
FIG. 12

THERMALLY STABLE HELICALLY PLIED CABLE

BACKGROUND OF THE INVENTION

This application is a continuation-in-part of application Ser. No. 466,174, filed May 2, 1974, now abandoned, which is a division of application Ser. No. 311,361, filed Dec. 1, 1972, now U.S. Pat. No. 3,821,879.

This invention relates to cables in which thermal elongation effects are controllable to obtain cables which either expand, contract, or remain essentially constant in length at various temperatures. The invention is illustrated and described herein with reference to a composite glass fiber cable comprising helically plied glass filaments which are embedded and bonded together in elastomeric bonding material; however, it will be apparent that other compatible strength and bonding materials may be used. As used herein, the term "strength material" refers to the tensile load bearing elements which serve to bear tensile loads applied to the cable and the term "bonding material" refers to the material in which the load bearing elements are embedded.

Metallic and non-metallic cables, such as glass fiber cables, commonly elongate with increasing temperature. The amount of thermally induced elongation is a function of the linear coefficient of thermal expansion of the cable material and the change in temperature to which the cable is subjected. In many cable applications, excessive or uncontrolled thermal elongation is highly undesirable. For example, thermal elongation of a cable used as the strength member in suspended electrical transmission lines can produce damaging sag in the line.

SUMMARY OF THE INVENTION

This invention provides a cable in which thermal elongation effects can be controlled to provide, depending upon the thermal expansion properties of the strength and bonding materials used, cables which either expand, contract or remain essentially constant in length under widely varying temperature conditions.

According to a preferred embodiment of the invention, the strength material is comprised of continuous filaments and the bonding material in which the filaments are embedded is comprised of elastomeric material. Preferably, the linear coefficient of thermal expansion of the elastomeric material is substantially greater than that of the filaments. The filaments are arranged in overlapping concentric layers in which they are plied helically at a constant helical angle from cable center to outer surface. The elastomeric material surrounds and bonds individual filaments to the filaments of the same and adjacent layers.

When heated, thermal elongation of the individual filaments is opposed by simultaneous radially directed thermal volumetric expansion of the elastomeric material. The tendency for the individual filaments to elongate with increasing temperature is opposed by a contractive tendency produced by radial expansion of the elastomeric material. Thus, with respect to overall cable length, thermal elongation of the cable with increasing temperature can be nulled by simultaneous increase in cable cross sectional area produced by the radial component of volumetric expansion of the elastomeric material. When cooled, of course, thermal contraction of the individual filaments is opposed by simultaneous radially directed volumetric contraction of the elastomeric material. This volumetric contraction of the elastomeric material produces a decrease in cable cross sectional area which serves to null thermal contraction of the cable. In either case, the greater the helical angle at which the filaments are plied, the greater the nulling action obtained, and vice versa. Thus, by controlling the helical angle at which the filaments are plied and maintaining it constant from the cable center to outer surface, it is possible, depending upon the thermal expansion properties of the filament and elastomeric materials used, to obtain either expanding, contracting or constant length cables. In most practical applications, control of cable length is obtained, by controlling the helical angle, regardless of tensile loading on the cable; however, in some high stress applications, the helical angle may further be related to the elasticity of the filament material used.

The helical angle at which the tensile load bearing elements may be plied to obtain a thermally stable cable is determined from the following formula:

$$\sin(x) = \sqrt{\frac{k_s}{k_B \%B}}$$

where sin (x)=sine helical angle x.

$k_B$=linear coefficient of thermal expansion of the bonding material.

$k_s$=linear coefficient of thermal expansion of the strength material.

%B=volumetric percentage of bonding material.

The principles of this invention are particularly suitable for use in glass fiber cables which comprise multiple concentric overlapping layers of helically plied glass fiber rovings, each of which includes a plurality of substantially untwisted, generally parallel glass filaments. Each filament is surrounded by a cured elastomeric sheath which is bonded to the sheath surrounding adjacent filaments in the same and adjacent layers. To fabricate the cable, the rovings are wound together helically to form an initial lay-up, and then additional layers of roving are wound helically about the initial lay-up, while maintaining the helical angle constant, until a cable of desired diameter is obtained. The composite glass fiber cable is fabricated using apparatus generally similar to the apparatus disclosed in U.S. Pat. No. 3,663,533, assigned to the assignee of this invention.

BRIEF DESCRIPTION OF THE DRAWINGS

FIG. 1 is a perspective of a section of the composite glass fiber cable of this invention, depicting a glass fiber roving being applied thereto during lay-up;

FIG. 2 is a cross-section of the cable of FIG. 1 depicting thermal volumetric expansion of the cable of FIG. 1;

FIG. 3 is a graph of temperature v. elongation and contraction of conventional cables and the glass fiber cable of FIG. 1 plied at various helical angles;

FIG. 4 is a graph of helical angle v. total contraction of the glass fiber cables of FIG. 3;

FIG. 5 is a graph generally similar to FIG. 3 depicting thermal elongation and contraction of the cable of FIG. 1 formed of different filaments materials plied at various helical angles;

FIGS. 6–9 are schematics depicting the effect of temperature upon a unit length of the cable of FIG. 1;

FIG. 10 is a graph of calculated helical angle of thermal stability v. the product of linear coefficient of thermal expansion of and percentage bonding material of the cable of FIG. 1 formed of strength materials of various linear coefficients of thermal expansion;

FIG. 11 is a graph of temperature v. contraction of the cable of FIG. 1 under varying tensile loads;

FIG. 12 is a schematic depicting the effect of tensile loading upon a unit length of the cable of FIG. 1.

DETAILED DESCRIPTION OF THE DRAWINGS

The glass fiber cable of FIGS. 1 and 2 comprises multiple overlapping concentric layers of helically plied glass fiber rovings 2. Each roving is made up of a plurality of substantially untwisted, generally parallel glass filaments 4. The filaments 4 are plied helically, as depicted in FIG. 1, at a helical angle (x) which is maintained constant from the cable center to outer surface. Each filament is surrounded by a cured elastomeric sheath which is bonded to the elastomeric sheaths surrounding adjacent filaments in both the same and adjacent layers to form an elastomeric cable matrix 6.

The glass fiber cable of FIGS. 1 and 2 is fabricated by winding a plurality of glass fiber rovings 2 together helically to form an initial lay-up, and thereafter winding additional glass fiber rovings 2 about the initial lay-up in helical fashion, as depicted in FIG. 1, to form multiple overlapping concentric layers until a cable of desired diameter is obtained. Consequently, the finished cable is coreless and substantially homogenous in cross-section.

The cured elastomeric sheath surrounding each filament is formed during the cable fabrication process using a two component elastomeric material. In one known process of manufacture, certain of the rovings are impregnated during lay-up of the initial and subsequent layers with one sheath component which is the uncured elastomeric material. The remaining rovings are impregnated with the other sheath component which is a curing agent or hardener. When the rovings are applied to the cable during lay-up, these two components react to form an elastomeric cable matrix in which each filament is surrounded by a cured elastomeric sheath which is bonded to the sheaths surrounding adjacent filaments in both the same and adjacent layers. Urethane elastomers are preferred for use in the glass fiber cables of this invention; however, the choice of the particular bonding material used will depend upon the type of filament material used and the desired thermal expansion properties of the elastomer. For example, other polymeric bonding materials may be used in this invention. The composite glass fiber cable of FIGS. 1 and 2, and the method and apparatus for making that cable are illustrated and described in detail in U.S. Pat. No. 3,662,533, the disclosure of which is hereby incorporated by reference.

It was an unexpected discovery that the composite glass fiber cable of the type described herein either expands, contracts or remains essentially constant in length under widely varying temperature conditions, depending upon the helical angle at which the glass roving is applied. Further, and contrary to conventional cable behavior, the teachings of this invention enable precise control of the thermal behavior of the cable by controlling the helical angle at which the glass filaments are plied in relation to the thermal expansion properties of the filament and elastomeric materials used.

When heated, thermal elongation of the individual filaments is opposed by simultaneous thermal volumetric expansion of the elastomeric material. As depicted by arrows in FIG. 2, the thermal volumetric expansion of the elastomer is primarily in the radial direction. This radially directed component of volumetric expansion of the elastomeric material produces a contractive tendency which opposes the tendency for the individual filaments to elongate with increasing temperature. Thus, with respect to overall cable length, thermal elongation of the cable with increasing temperature can be nulled by an increase in cable cross sectional area produced by the radial component of volumetric expansion of the elastomeric material to obtain a thermally stable cable.

The amount of elastomeric material present per unit length of cable, and hence the nulling action obtained is controlled by the helical angle at which the rovings are applied. Inasmuch as the filaments are surrounded by the elastomeric material which comprises the cable matrix 6, the amount of elastomeric material contained in a length of cable can be increased by increasing the number of turns of filaments 4 per unit length of cable. The greater the number of turns or rovings 2, containing filaments 4, applied per length of cable, the greater the nulling action obtained, and vice versa. The helical angle (x) at which the rovings are applied, of course, determines the number of turns of roving, and hence the amount of elastomeric material per length of cable. Thus, the helical angle at which the glass roving is applied can be utilized as the controlling factor in determining whether a given length of cable will be thermally stable, contract or elongate when heated to a specific temperature. Consequently, it is possible, by selecting the helical angle at which the glass rovings are applied in relation to the thermal expansion properties of the filament and elastomeric materials used and by maintaining the helical angle constant from the cable center to outer surface during lay-up, to obtain either expanding, contracting or constant length cables. It will be recognized, of course, that the amount of elastomeric or other bonding material present per unit length of cable may be controlled by other means.

When cooled, of course, thermal contraction of the individual filaments is opposed by simultaneous thermal volumetric contraction of the elastomeric material in the radial direction. This radially directed component of volumetric contraction of the elastomeric material produces a decrease in cable cross sectional area which opposes thermal contraction of the overall cable. Thus, the principles of this invention further apply to controlling thermal contraction effects of cables which are cooled; however, for purposes of clarity and understanding, the invention is illustrated and described hereinafter with respect to cables in which thermal elongation effects produced by cable heating are controlled.

The unit length of cable, with respect to a particular cable layer, is termed herein the "lead" distance which is expressed as the product of the cotangent of helical angle and cable circumference:

$$b = a \cot(x) \qquad (1.)$$

where:

b = lead distance cot (x) = cotangent helical angle (x)

a=cable outer circumference

The lead distance in Equation (1.) is the length traveled, measured along the longitudinal axis of the cable, by one complete 360° helical twist of roving 2 about the cable. The roving follows the path of a helix, as indicated in FIG. 1. It will be understood, of course, that the lead distance for each cable layer becomes progressively longer, and hence the number of turns of roving in each layer progressively decreases, from cable center to outer surface, when the helical angle is maintained constant during lay-yp of all layers of cable. In most practical cases, however, accurate experimental results and calculations are obtained by referring only to the lead distance of the cable outer surface or finished diameter. This is due to the physical characteristics of the elastomeric cable matrix 6, and the fact that thermal elongation effects with respect to a unit length of cable comprising multiple overlapping layers, are uniform throughout the cable cross sectional area. It will be understood, therefore, that all reference hereinafter to a particular "lead" refers to the "lead" distance of the outer layer of cable.

The unique thermal behavior of the glass fiber cable of this invention may best be understood by first referring to the test results depicted in FIG. 3 in which conventional and helically plied glass cables of differing helical angles were tested under similar conditions of temperature and tensile loading. The cables tested were subjected to temperatures ranging from 70° to 170° F. and a tensile load of about 2,000 lbs.

Of the conventional cables tested, test cable 1 consisted of a cylindrical grouping of parallel glass fibers which elongated about 0.015 inches for a 100-inch cable section. Cable 2, a wire rope 5/16 inch in diameter, elongated about 0.045 inches for a 100-inch cable section. Cable 3 consisted of steel banding 0.025×0.500inches and elongated about 0.078 inches for a 100-inch cable section.

Of the helically plied glass fiber cables tested, all were three-eighths inch in diameter and fabricated in a manner described in U.S. Pat. No. 3,662,533 except that the uncured urethane resin applied to the glass fiber rovings prior to twisting was incorporated in the curing agent. The filament material used was a commercially available glass, manufactured by Owens Corning Corporation, known as "S" glass. As illustrated by FIG. 3, cable (a), made up of filaments plied at a helical angle of about 25° 15 minutes, contracted about 0.070 inches for a 100-inch cable section. Cable (b), made up of filaments plied at a helical angle of about 21° 50 minutes, contracted about 0.04 inches for a 100-inch cable section. Cable (c), made up of filaments plied at a helical angle of about 17° 25 minutes, contracted about 0.025 inches from a 100-inch cable section. Cable (d), made up of filaments plied at a helical angle of about 11° 45 minutes, contracted about 0.007 inches for a 100-inch cable section. Cable (e), made up of filaments plied at a helical angle of about 7° 6 minutes, contracted about 0.002 inches per 100-inch cable section.

FIG. 5 graphically illustrates the effects of helical angle upon thermal stability of the glass fiber cable of FIG. 1. FIG. 4 depicts helical angle v. total contraction of cables (a)-(e) of FIG. 3. Cables (d) and (e), which were plied at helical angles below about 11° 45 minutes, maintained essentially constant overall length at temperatures ranging from 70° F. to 170° F. That is, these cables were thermally stable when heated 100° F. The remaining cables tested, which were plied at helical angles above that helical angle, however, tended to contract excessively when heated 100° F. such that they were not thermally stable.

As depicted in FIG. 5, the thermal expanision properties of the filament material used influences the thermal elongation behavior of the cable of FIG. 1. Cables designated (d) and (c) correspond to cables (d) and (c) in FIG. 3 and were fabricated of "S" glass filaments plied at helical angles of about 11° 45 minutes and 17° 15 minutes, respectively. Two additional generally similar cables (f) and (g) were fabricated of a commercially available glass, manufactured by Owens Corning Corporation, known as "E" glass. The "E" glass filaments of cables (f) and (g) were plied at helical angles of about 18° and 11°, respectively. The linear coefficients of thermal expansion of "E" and "S" glass are $2.8\times10^6$ in/in°F. and $1.6\times10^6$ in/in°F., respectively. When these four cables were subjected to the same tensile loading under the temperature conditions indicated, both "S" glass cables (d) and (c) exhibited greater contraction. The "E" glass cables (f) and (g), due to the higher linear coefficient of thermal expansion of the "E" glass filament used, contracted less than the "S" glass cables under the same temperature conditions. Apparently, the contractive influence produced by volumetric expansion of the elastomer which comprised the cable matrix failed to null increased thermal elongation produced by the "E" glass filaments.

It will be recognized that the thermal expansion characteristics of the elastomer used also will affect the thermal behavior of cables according to this invention. For example, it is possible, as will presently be described, by using an elastomer, polymer or other bonding material of sufficient radial component of thermal expansion, to null the thermal elongation tendency of the "E" glass filaments depicted in FIG. 5 to obtain a thermally stable cable.

It is now possible to calculate, for a selected helical angle, the thermal elongation behavior of a helically plied cable of the type described, given the thermal expansion properties of the filament and elastomeric materials used, or of other mutually compatible strength and bonding materials. Referring now to FIG. 6, the relationship of the cable outer circumference (a), cable unit length or lead distance (b), and the length of one full 360° twist of glass fiber roving (c), shown in broken lines, are represented by a right triangle bounded by sides "a," "b" and "c." The relative lengths of sides "a," "b" and "c" is expressed in the equation:

$$c^2=a^2+b^2 \qquad (2.)$$

For each layer of glass roving applied at constant helical angle, the circumference, lead, and roving length will be represented, with respect to a unit length of cable corresponding to one lead distance, by a generally similar right triangle in which the relative lengths of sides "a," "b" and "c" will vary with diameter. However, as already described above, accurate results are obtained, in most practical cases, by referring to the outside or finished cable layer. Thus, the following calculation refers to this layer.

As the temperature of the cable changes, the glass roving will expand or contract in length. Referring to FIG. 7, with an increase in cable temperature the roving length "c" twisted about a given lead distance "b" will increase in length by an increment "Δc." Assuming no increase in cable circumference "a", this increase in length of roving will produce a simultaneous increase in the lead distance "b" by an increment "$\Delta b_e$." As depicted in FIG. 7, a new triangle results. This new triangle will have increased roving and cable lengths, as indicated in broken lines by the sides "$c+\Delta c$" and "$b+\Delta b_e$." The relationship of cable circumference, cable length and roving length from Equation (2.) will now be.:

$$(c+\Delta c)^2=(b+\Delta b_e)^2+a^2$$

By simplifying this equation, the incremental increase in cable length, $\Delta b_e$, is determined by substituting "$c^2-a^2$" for the term "$b^2$" of Equation (1.) and omitting, as negligible, second order differential terms "$\Delta b^2$" and "$\Delta c^2$":

$$b_e=c\Delta c/b \tag{3.}$$

As the temperature of the cable changes, the bonding material will expand and contract radially. As depicted in FIG. 8, upon increase in cable temperature, the cable will increase in cross sectional area and hence its circumference "a" will increase by increment "$\Delta a$." Assuming no change in length of roving "c," this increase in cable circumference will produce a simultaneous decrease in the lead distance "b" by an increment "$\Delta b_c$." As depicted in FIG. 8, a new triangle results. This new triangle will have increased roving length and decreased cable length indicated in broken lines by the sides "$a+\Delta a$" and "$b-\Delta b_c$." The relationship of cable circumference, cable length and roving length from Equation (2.) will now be:

$$c^2=(b-\Delta b_c)^2+(a+\Delta a)^2$$

By simplifying this equation, the decrease in cable length, $\Delta b_c$ is determined by substituting "$c^2-a^2$" for the term "$b^2$" and omitting, as negligible, second order differential terms "$\Delta b^2$" and "$\Delta a^2$."

$$b_c=-(a\Delta a/b) \tag{4.}$$

Summing Equations (3.) and (4.)

$$\Delta b_e+\Delta b_c=\frac{c\Delta c-a\Delta a}{b}$$

Therefore, for no change in cable length:

$$c\Delta c=a\Delta a \tag{5.}$$

It is also possible to arrive at Equation (5.) by another analysis, depicted in FIG. 9. When heated, increase in cross-sectional area and elongation of the cable occur simultaneously, as describe previously, so that when cable elongation "$\Delta b_e$" is equal to cable contraction "$\Delta b_c$," the cable is thermally stable. That is, each cable unit length, or lead distance "b," remains at constant length with changing temperature. This condition is represented by the triangle of FIG. 9 from which:

$$(c+\Delta c)^2-(a+\Delta a)^2=b^2$$

From Equation (2.)

$$c^2-a^2=b^2$$

Combining these two expressions:

$$(c+\Delta c)^2-(a+\Delta a)^2=c^2-a^2$$

$$2c\Delta c+\Delta c^2=2a\Delta a-\Delta a^2$$

The second order differential terms "$\Delta c^2$" and "$\Delta a^2$" are negligible and can be omitted to again arrive at Equation (5.) above.

The term "$\Delta c$" in Equation (5.) can be expressed as follows:

$$\Delta c=ck_S\Delta T \tag{6.}$$

where:

$k_s$=linear coefficient of thermal expansion of the strength material (i.e., the glass filaments in the example of FIG. 1).

$\Delta T$=temperature change.

The term "$\Delta a$" in Equation (5.) can be expressed as follows:

$$\Delta a=ak_B\Delta T\%B \tag{7.}$$

where:

$k_B$=linear coefficient of thermal expansion of the bonding material (i.e., the elastomer in the example of FIG. 1).

$\Delta T$=temperature change

%B=cross sectional volumetric percentage of bonding material.

Substituting the expressions for "$\Delta c$" and "$\Delta a$" of Equations (6.) and (7.) into Equation (5.)

$$c^2\,k_s\,\Delta T=a^2\,k_B\,\Delta T\,\%B \tag{8.}$$

$$c^2=\frac{a^2\,k_B\,\%B}{k_s}$$

From Equation (2.)

$$c^2=a^2+b^2$$

Equating the expressions for the term "$c^2$" of Equations (8.) and (2.) and substituting for the term "b" from Equation (1.), it is possible to arrive at an expression for helical angle (x):

$$\frac{a^2\,k_B\,\%B}{k_s}=a^2+a^2\,[\cot(x)]^2 \tag{9a.}$$

$$\cot(x)=\sqrt{\frac{k_B\,\%B}{k_s}-1}$$

Alternatively, by substituting the expression for sin(x) in FIG. 6 (sin(x)=a/c) into Equation (8.), it is possible to arrive at an equivalent preferred expression for helical angle (x):

$$\sin(x)=\sqrt{\frac{k_s}{k_B\,\%B}} \tag{9b.}$$

Thus, it is possible, using Equations (9a.) or (9b.), to provide a helically plied cable, composed of filament and bonding materials having certain linear coefficients of thermal expansion, which will be thermally stable or remain essentially constant in length under widely varying temperature conditions, including both heating and cooling.

FIG. 10 represents, in graphical form, helical angles of thermal stability, calculated from Equations (9a.) and (9b.), for strength and bonding materials of various linear coefficients of thermal expansion. Curves (h), (i) and (j) depict calculated helical angles of thermal stability for strength and bonding materials having linear coefficients of thermal expansion of: 1.8; 2.8; and $3.8\times10^{-6}$ in/in°F., respectively. Curves (h) and (i) generally represent "S" and "E" glass cables, respectively. As will be appreciated from FIG. 10, the greater the linear coefficient of thermal expansion of and/or the greater the percentage bonding material used, the smaller the helical angle must be to provide a thermally stable cable. Likewise, the greater the linear coefficient of thermal expansion of the strength material used, the greater the helical angle must be to provide a thermally stable cable. Preferably, the linear coefficient of thermal expansion of the bonding material is substantially greater than that of the strength material.

It will be recognized that, due to the large difference between thermal coefficients of linear expansion of the preferred strength and bonding materials, volumetric or radial expansion of the strength material, such as glass filaments, is negligible relative to that of most elastomeric bonding materials. Consequently, in Equations (7.), (8.) and (9a.) and (9b.) the radial expansion of the strength material and its influence upon radial expansion of the body of bonding material is assumbe to be neglible. The term "%B" used in these equations, in effect, relates thermal radial expansion of the cable to the volumetric percentage of bonding material used. It will be understood, of course, that, for cables made up of other strength and bonding materials, thermal radial expansion of both the strength and bonding materials, or their effects upon each other, may be considered in determining the helical angle of thermal stability of the cable. Furthermore, the effects of temperature upon the linear coefficients of thermal expansion of the strength and bonding materials used also may be considered in determining the helical angle of thermal stability.

Inasumch as increasing the helical angle produces a greater number of turns of roving per length of cable, the tension modulus of the helically plied cable of this invention can be controlled by controlling the helical angle. The greater the number of turns of roving per length of cable, the greater the tendency for the cable to stretch as the turns of roving are straightened relatively along the length of cable in response to applied load. Thus, by applying the rovings at a large helical angle, a lower cable tensile modulus is obtained. (i.e., The cable has a greater tendency to stretch in response to applied tensile load.) Conversely, at small helical angels, the rovings are more nearly parallel to the longitudinal axis of the cable, with fewer turns of roving per length of cable, and a higher cable tensile modulus is obtained. (i.e., The cable has a lesser tendency to stretch in response to applied tensile load.) Thus, by referring to Equations (9a.) or (9b.) and FIG. 10, it will be appreciated that it is possible, by selecting the strength and bonding materials used, and the percentage bonding material, to produce a thermally stable cable having a desired tensile modulus. For example, by increasing the percentage of bonding material used in FIG. 10, for a certain set of strength and bonding materials, the helical angle of thermal stability may be reduced sufficiently to obtain a thermally stable cable of increased cable tensile modulus.

FIG. 11 depicts the effects of tensile loading upon the cable of FIG. 1. The cable tested was generally similar to the three-eighths inch diameter, 100-inch length cables described with reference to FIG. 3 and was plied at a helical angle of about 17° 25 minutes. At tensile loadings of 500 lbs., 1050 lbs. and 2050 lbs., and under the temperature conditions indicated, overall cable contraction did not change significantly. Thus, in most practical cable applications involving tensile loadings similar to those tested, it appears that tensile loading will not affect thermal elongation of the cable; however, as stated previously, in some cable applications involving very high tensile loads, dependent upon the helical angle at which the filaments are plied, tensile loads may stretch the overall cable to the point that the filaments straighten or shift longitudinally. Consequently, with sufficient relative straightening of the filaments, the helical angle is decreased as depicted in FIG. 11. The end result is that the number of turns of roving per unit length of cable is reduced, and less contractive or nulling action is obtained for a given temperature range.

It is now possible to calculate the theoretical tensile loads required to produce sufficient relative straightening of the rovings or filaments to significantly affect the helical angle and hence the nulling action obtained. Referring now in particular to FIG. 11, when tensile load (T) is applied to the cable of FIG. 1, elongation of the cable will occur, dependent upon the modulus of elasticity (E) of the filament material used. The resultant cable elongation, "$\Delta b_s$," with respect to a unit length of cable or lead distance "b," can be expressed as follows:

$$\Delta b_s = bS/E \tag{10.}$$

where:

b=lead distance (see Equation (1.))

S=tensile stress

E=Modulus of elasticity of the strength material (i.e., the filaments in the example of FIG. 1).

An expression for the resultant cable length ($b+\Delta b_s$) is obtained by substituting the previously noted expression for the term lead distance "b" from Equation (1.) into Equation (10.)

$$b + \Delta b_s = a\cot(x)\left(1 + \frac{S}{E}\right) \tag{11.}$$

As described previously, the helical angle may decrease, due to longitudinal straightening of the rovings and filaments, in response to some applied tensile loads. This condition is depicted in FIG. 11 by smaller helical angle "y." Referring to the longitudinally enlarged triangle which includes angle "y," assuming cable circumference "a" remains constant:

$$\cot(y) = \frac{b + \Delta b_s}{a} \tag{12.}$$

$$b + \Delta b_s = a\cot(y)$$

Equating the expressions for "$b+\Delta b_s$" of Equations (11.) and (12.), it is possible to arrive at an expression for the decreased helical angle "y" which is produced in response to tensile loadings:

$$\cot(y) = \cot(x)\left(1 + \frac{S}{E}\right) \tag{13.}$$

Thus, it is possible, given the plied helical angle "x" of thermal stability, to calculate, using Equation (13.), the helical angle "y" which is or may be produced in response to tensile load "T." It will now be appreciated from Equation (13.) that, for most practical cable applications, tensile load is insufficient to produce a significant change in helical angle of thermal stability, depending upon the modulus of elasticity of the filaments used. In fact, the tensile load "T" generally exceeds the tensile stresses which are normally encountered in most practical cable applications, including electrical transmission lines, or exceeds the ultimate tensile strength of the filaments used. For example, a tensile stress of 10,000 psi applied to a cable fabricated of "E" glass filaments will produce an insignificant change in helical angle; however, in other applications, it is possible to predict what tensile stress or loading is necessary to produce the helical angle "y," using Equation (13.). In the latter applications, it then is possible to increase the plied helical angle "x" during fabrication an amount sufficient to compensate for the effects of tensile stress or loading. The end result, in the latter applications, is a cable which, in response to applied tensile loads, is thermally stable, or expands and contracts to the same extent as the cables of FIGS. 1–10.

It will be recognized by one of ordinary skill that, in addition to glass filaments and elastomeric materials, other mutually compatible strength and bonding materials may be used in this invention. The particular choice of strength and bonding material will depend upon their chemical and thermal expansion properties, the environment in which the cabe is to be used, and other factors. Accordingly, the invention is not to be limited to the specific embodiment illustrated and described herein and the true scope and spirit of the invention are to be determined by reference to the appended claims.

The embodiments of the invention in which an exclusive property or privilege is claimed are defined as follows:

1. A cable, comprising: tensile load bearing elements which can change in length in response to variation in temperature; and thermal radial expansion means operably associated with said load bearing elements in sufficient quantity that overall cable length may be controlled under varying temperature conditions by producing change in the cross sectional area of the cable in opposition to and substantially simultaneously with change in length of said load bearing elements.

2. The cable of claim 1, wherein said thermal radial expansion means is present in such quantity as to produce sufficient change in cross sectional area of the cable that thermal elongation and contraction of said load bearing elements can be nulled, whereby the cable remains essentially constant in length under varying temperatures.

3. The cable of claim 1, wherein said load bearing elements comprise continuous filaments helically plied at substantially constant helical angle; and said thermal radial expansion means comprises a plurality of cured elastomeric sheaths, each surrounding a filament and bonded to the sheaths surrounding adjacent filaments to form a cable matrix which expands and contracts radially in response to increasing and decreasing temperature, respectively, to thereby produce an increase and decrease in cable cross sectional area.

4. The cable of claim 3, wherein said filaments are glass.

5. The cable of claim 3, wherein said elastomer is a urethane elastomer.

6. The cable of claim 1, wherein the linear coefficient of thermal expansion of said thermal radial expansion means are substantially greater than the linear coefficient of thermal expansion of said load bearing elements.

7. A cable, comprising: strength material including tensile load bearing elements; and bonding material surrounding said load bearing elements; said load bearing elements being helically plied at substantially constant helical angle selected to provide bonding material in sufficient quantity that thermal elongation of the cable produced by thermal elongation of said load bearing elements can be opposed by simultaneous increase in cable cross sectional area produced by thermal radial expansion of said bonding material.

8. The cable of claim 7, wherein said bonding material produces sufficient increase in cable cross sectional area that thermal elongation of said load bearing elements can be nulled, whereby the cable remains essentially constant in length under varying temperatures.

9. The cable of claim 7, wherein said load bearing elements comprise continuous filaments; and said bonding material comprises a plurality of cured elastomeric sheaths, each surrounding a filament and bonded to the sheaths surrounding adjacent filaments to form a cable matrix which expands radially in response to increasing temperature, to thereby produce an increase in cable cross sectional area.

10. The cable of claim 9, wherein said filaments are glass.

11. The cable of claim 9, wherein said elastomer is a urethane elastomer.

12. The cable of claim 7, wherein the linear coefficient of thermal expansion of said bonding material is substantially greater than the linear coefficient of thermal expansion of said strength material.

13. A cable, comprising: strength material including tensile load bearing elements; and bonding material surrounding said load bearing element to form a cable matrix; said load bearing elements being plied at substantially constant helical angle selected to provide bonding material in sufficient quantity that thermal elongation of the cable produced by thermal elongation of said load bearing elements can be nulled by simultaneous increase in cable cross sectional area produced by thermal radial expansion of the cable matrix, whereby the cable remains essentially constant in length under varying temperatures.

14. The cable of claim 13, wherein said helical angle further is selected in relation to elasticity of said strength material such that elongation of the cable in response to application of tensile load reduces said helical angle sufficiently to maintain essentially constant cable length under varying temperatures.

15. The cable of claim 13, wherein said helical angle further is selected to produce a desired cable tensile modulus.

16. A thermally stable cable, comprising: strength material including tensile load bearing elements; and bonding material surrounding said load bearing elements; said load bearing elements being helically plied at substantially constant helical angle which is determined by the formula:

$$\sin(x) = \sqrt{\frac{k_s}{k_B \%B}}$$

where sin(x) is the sine of helical angle x; $k_B$ and $k_S$ are the linear coefficients of thermal expansion of the bonding and strength materials, respectively; and %B is the volumetric percentage bonding material.

17. The cable of claim 16 wherein the helical angle produced in response to an applied tensile load is determined by the formula:

$$\cot(y) = \cot(x)\,(1 + \frac{S}{E})$$

where cot(y) is the cotangent of helical angle y produced in response to an applied tensile load; cot (x) is the cotangent of helical angle x at which the load bearing elements are plied during lay-up; S is tensile stress produced by an applied tensile load; and E is the modulus of elasticity of the strength material.

18. A method of making a cable, comprising the steps of:

combining a plurality of tensile load bearing elements which can change in length in response to variation in temperature with thermal radial expansion means for producing change in the cross sectional area of the cable in opposition to and substantially simultaneously with change in length of said load bearing elements; and controlling the quantity of said radial expansion means present such that overall cable length can be controlled under varying temperatures.

19. The method of claim 18, wherein said thermal radial expansion means is present in such quantity as to produce sufficient change in cross sectional area of the cable that thermal elongation and contraction of said load bearing elements can be nulled, whereby the cable remains essentially constant in length under varying temperatures.

20. The method of claim 18, wherein said controlling step comprises the additional steps of:

helically plying said load bearing elements at substantially constant helical angle; and surrounding said load bearing elements with said radial expansion means to form a cable matrix;

said helical angle being selected in relation to thermal expansion of said tensile load bearing elements and said radial expansion means such that thermal elongation of said load bearing elements can be nulled by simultaneous increase in cable cross sectional area produced by thermal radial expansion of the cable matrix, whereby the cable remains essentially constant in length under varying temperatures.

21. The method of claim 20, wherein said helical angle further is selected in relation to elasticity of said strength material such that elongation of the cable in response to application of tensile load reduces said helical angle sufficiently to maintain essentially constant cable length under varying temperatures.

22. The method of claim 20, wherein said helical angle further is selected to produce a desired cable tensile modulus.

23. The method of claim 20, wherein said surrounding step comprises the additional steps of:

surrounding each filament with a cured elastomeric sheath; and simultaneously bonding the sheaths surrounding each filament to the sheaths surrounding adjacent filaments to form said matrix.

24. A method of making a glass fiber cable, comprising the steps of:

helically winding a plurality of glass fiber rovings to form successive layers of increasing diameter;

surrounding the filaments of each roving with an uncured elastomeric resin having a curing agent or hardener in contact therewith to form an elastomeric cable matrix; and maintaining the helical angle of the initial and successive layers during lay-up at a substantially constant value selected to provide cured elastomeric resin in sufficient quantity that thermal elongation of the cable produced by thermal elongation of the filaments can be nulled by simultaneous increase in cable cross sectional area produced by thermal radial expansion of the cable matrix, whereby the cable remains essentially constant in length under varying temperatures.

25. The method of claim 24, wherein said helical angle further is selected in relation to elasticity of said filaments such that elongation of the cable in response to application of tensile load reduces said helical angle sufficiently to maintain essentially constant cable length under varying temperatures.

26. The method of claim 24, wherein said helical angle further is selected to produce a desired cable tensile modulus.

27. A cable fabricated by the process of combining a plurality of tensile load bearing elements which can change in length in response to variation in temperature with thermal radial expansion means for producing change in the cross sectional area of the cable in opposition to and substantially simultaneously with change in length of said load bearing elements; and controlling the quantity of said radial expansion means present such that overall cable length can be controlled under varying temperatures.

28. The cable of claim 27, wherein said thermal radial expansion means is present in such quantity as to produce sufficient change in cross sectional area of the cable that thermal elongation and contraction of said load bearing elements can be nulled, whereby the cable remains essentially constant in length under varying temperatures.

29. The cable of claim 27, wherein said controlling step comprises the additional steps of helically plying said load bearing elements at substantially constant helical angle; and surrounding said load bearing elements with said radial expansion means to form a cable matrix; said helical angle being selected in relation to thermal expansion of said tensile load bearing elements and said radial expansion means such that thermal elongation of said load bearing elements can be nulled by simultaneous increase in cable cross sectional area produced by thermal radial expansion of the cable matrix, whereby the cable remains essentially constant in length under varying temperatures.

30. The cable of claim 29, wherein said helical angle further is selected in relation to elasticity of said strength material such that elongation of the cable in response to application of tensile load reduces said helical angle sufficiently to maintain essentially constant cable length under varying temperatures.

31. The cable of claim 29, wherein said helical angle further is selected to produce a desired cable tensile modulus.

32. A glass fiber cable fabricated by the process of helically winding a plurality of glass fiber rovings to form successive layers of increasing diameter; surrounding the filaments of each roving with an uncured elastomeric resin having a curing agent or hardener in contact therewith to form an elastomeric cable matrix; and maintaining the helical angle of the initial and successive layers during lay-up at a substantially constant value selected to provide cured elastomeric resin in sufficient quantity that thermal elongation of the cable produced by thermal elongation of the filaments can be nulled by simultaneous increase in cable cross sectional area produced by thermal radial expansion of the cable matrix, whereby the cable remains essentially constant in length under varying temperatures.

33. The cable of claim 32, wherein said helical angle further is selected in relation to elasticity of said filaments such that elongation of the cable in response to application of tensile load reduces said helical angle sufficiently to maintain essentially constant cable length under varying tempertures.

34. The cable of claim 32, wherein said helical angle further is selected to produce a desired cable tensile modulus.

35. The method of claim 18, wherein the quantity of radial expansion means present is controllable by surrounding the load bearing elements with radial expansion means and plying the load bearing elements at substantially constant helical angle which is determined by the formula:

$$\sin(x) = \sqrt{\frac{k_s}{k_B\,\%B}}$$

where sin(x) is the sine of helical angle x; $k_B$ and $k_s$ are the linear coefficients of thermal expansion of the radial expansion means and tensile load bearing elements, respectively; and %B is the volumetric percentage radial expansion means.

36. The cable of claim 35 wherein the helical angle at which the load bearing elements are plied is controllable in relation to the helical angle produced in response to an applied tensile load as determined by the formula:

$$\cot(y) = \cot(x)\,(1 + \frac{S}{E})$$

where cot(y) is the cotangent of helical angle y produced in response to an applied tensile load; cot(x) is the cotangent of helical angle x at which the load bearing elements are plied during lay-up; S is tensile stress produced by an applied tensile load; and E is the modulus of elasticity of the load bearing elements.

37. The cable of claim 27, wherein the quantity of radial expansion means present is controllable by surrounding the load bearing elements with radial expansion means and plying the load bearing elements at substantially constant helical angle which is determined by the formula:

$$\sin(x) = \sqrt{\frac{k_s}{k_B\,\%B}}$$

where sin(x) is the sine of helical angle x; $k_B$ and $k_s$ are the linear coefficients of thermal expansion of the radial expansion means and tensile load bearing elements, respectively; and %B is the volumetric percentage radial expansion means.

38. The cable of claim 37 wherein the helical angle at which the load bearing elements are plied is controllable in relation to the helical angle produced in response to an applied tensile load as determined by the formula:

$$\cot(y) = \cot(x)\,(1 + \frac{S}{E})$$

where cot(y) is the cotangent of helical angle y produced in response to an applied tensile load; cot(x) is the cotangent of helical angle x at which the load bearing elements are plied during lay-up; S is tensile stress produced by an applied tensile load; and E is the modulus of elasticity of the load bearing elements.

39. A method of controlling thermal elongation of a composite stress member including a load bearing element, which method comprises controlling the cross sectional area of the stress member in accordance with transverse thermal expansion and contraction characteristics thereof such that variation in cross sectional area counteracts the effects of thermal elongation and contraction characteristics of the load bearing element on the length of the stress member, whereby the length of the stress member is controllable under varying temperature conditions.

40. The method of claim 39, wherein the stress member is composed of tensile load bearing elements helically plied at substantially constant helical angle which is determined by the formula:

$$\sin(x) = \sqrt{\frac{k_s}{k_B\,\%B}}$$

where sin(x) is the sine of helical angle x; $k_B$ and $k_s$ are the linear coefficients of thermal expansion of the elastomer and load bearing elements, respectively; and %B is the volumetric percentage elastomer; and wherein the helical angle produced in response to an applied tensile load is determined by the formula:

$$\cot(y) = \cot(x)\,(1 + \frac{S}{E})$$

where cot(y) is the cotangent of helical angle y produced in response to an applied tensile load; cot(x) is the cotangent of helical angle x at which the load bearing elements are plied during lay-up; S is tensile stress produced by an applied tensile load; and E is the modulus of elasticity of the load bearing elements.

* * * * *